US007668488B2

(12) United States Patent
Guzman et al.

(10) Patent No.: US 7,668,488 B2
(45) Date of Patent: Feb. 23, 2010

(54) LIQUID ELECTRO-PHOTOGRAPHY PRINTING DEVICE BINARY INK DEVELOPER HAVING SUCTION CAVITIES

(75) Inventors: Marco A. Guzman, San Diego, CA (US); Ziv Gilan, Moshav (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 249 days.

(21) Appl. No.: 11/872,663

(22) Filed: Oct. 15, 2007

(65) Prior Publication Data

US 2009/0097883 A1 Apr. 16, 2009

(51) Int. Cl.
*G03G 15/10* (2006.01)

(52) U.S. Cl. ..... 399/249; 399/237

(58) Field of Classification Search ..... 399/237, 399/239, 249

See application file for complete search history.

(56) References Cited

U.S. PATENT DOCUMENTS 4,227,797 A * 10/1980 Tsunoi ..... 399/239
4,327,664 A 5/1982 Ohkawa et al.
5,561,264 A * 10/1996 Iino et al. ..... 399/249 X
5,826,148 A * 10/1998 Iino et al. ..... 399/239 X
6,108,508 A * 8/2000 Takeuchi et al. ..... 399/239 X
6,108,513 A 8/2000 Landa et al.
6,999,701 B2 * 2/2006 Yoshino et al. ..... 399/237
7,221,889 B2 5/2007 Patton et al.
2006/0153596 A1 * 7/2006 Gilan et al. ..... 399/237
2006/0153597 A1 7/2006 Guzman et al.
2006/0204275 A1 9/2006 Patton et al.
2006/0291907 A1 * 12/2006 Tanner et al. ..... 399/237

FOREIGN PATENT DOCUMENTS

JP 2006-039142 A 2/2006
JP 2006-243047 A 9/2006

OTHER PUBLICATIONS

International Search Report, Mailing Date Apr. 22, 2009 for International Application No. PCT/US2008/078631 Filing Date Oct. 2, 2008.

* cited by examiner

*Primary Examiner*—Sandra L Brase

(57) ABSTRACT

A binary ink developer (BID) for a liquid electro-photography (LEP) printing device includes a sponge roller to absorb unused ink. The BID includes a squeezer roller to release the unused ink absorbed by the sponge roller for reuse. The squeezer roller releases the unused ink absorbed by the sponge roller by compressing the sponge roller. Compression of the sponge roller results in ink foam. The BID includes a mechanism having a wall, and a housing that together with the wall of the mechanism defines a passageway between the housing and the wall. The passageway is exposed externally to the BID. The BID includes one or more suction cavities defined within the wall of the mechanism through which the ink foam moves back from the passageway.

20 Claims, 5 Drawing Sheets

LIQUID ELECTRO-PHOTOGRAPHY PRINTING DEVICE BINARY INK DEVELOPER HAVING SUCTION CAVITIES

BACKGROUND

An electro-photography (EP) printing device forms an image on media typically by first selectively charging a photoconductive drum in correspondence with the image. Colorant is applied to the photoconductive drum where the drum has been charged, and then this colorant is transferred to the media to form the image on the media. Traditionally, the most common type of EP printing device has been the laser printer, which is a dry EP (DEP) printing device that employs toner as the colorant in question. More recently, liquid EP (LEP) printing devices have become popular.

An LEP printing device employs ink, instead of toner, as the colorant that is applied to the photoconductive drum where the drum has been charged. An LEP printing device typically includes a binary ink developer (BID) that applies the ink to the photoconductive drum where the drum has been charged. Any ink that is not applied to the photoconductive drum may be recycled for reuse. However, the ink recycling process can result in undesired ink foam to be generated. Left unchecked, the ink foam can migrate outside of the BID, causing image quality issues and other problems.

DETAILED DESCRIPTION OF THE DRAWINGS

Figure 1:
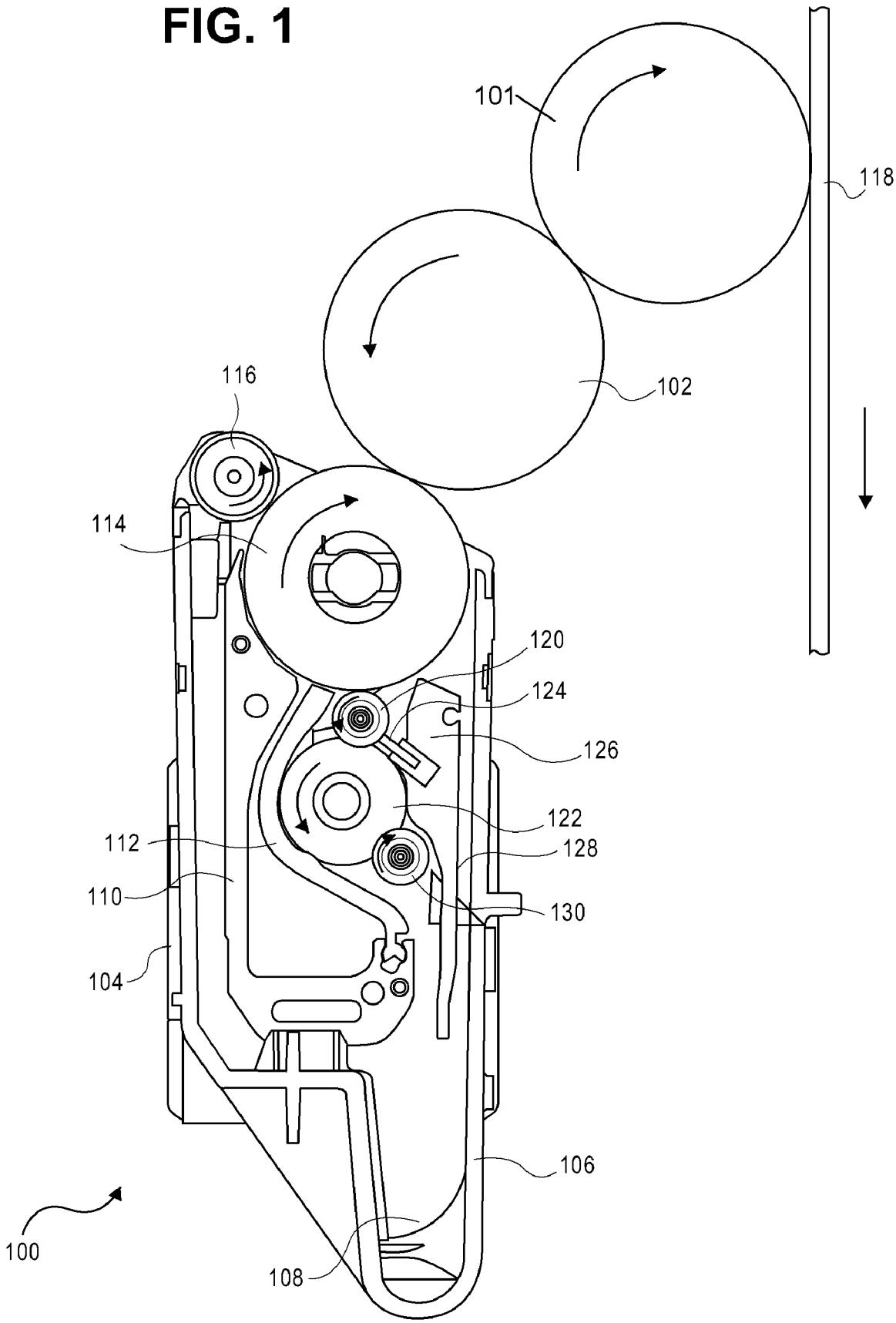
FIG. 1 is a diagram of a liquid electro-photography (LEP) printing device having a binary ink developer (BID), according to an embodiment of the present disclosure.

FIG. 1 shows a liquid electro-photography (LEP) printing device 100, according to an embodiment of the present disclosure. The LEP printing device 100 includes a blanket drum 101, a photoconductive drum 102, and a binary developer (BID) 104. As can be appreciated by those of ordinary skill within the art, the LEP printing device 100 can include other components, in addition to and/or in lieu of those depicted in FIG. 1.

The BID 104 of the LEP printing device 100 includes a housing 106 within which the other components of the BID 104 are at least substantially disposed. The housing 106 defines an ink tray 108 that stores ink that is ultimately used to form an image on a media sheet 118. The ink is a combination of liquid and solid, such as 80% liquid and 20% solid in one embodiment. The liquid may be oil or another type of liquid, and the solid may be pigment or another type of solid.

The BID 104 includes a primary electrode 110 and a secondary electrode 112. Both The primary electrode 110 and secondary electrode 110 may be at a negative electrical potential, such as −1500 volts. The ink in a state where it is more liquid than solid migrates or travels between the electrodes 110 and 112 to coat a developer roller 114 of the BID 104. The developer roller 114 is at an electrical potential that is less negative than the electrode 110, such as −450 volts. The developer roller 114 rotates as indicated in FIG. 1.

The BID 104 includes a squeegee roller 116, which rotates in the opposite direction as compared to the developer roller 114, and which is at an electrical potential that is more negative than the developer roller 114, such as −750 volts. The squeegee roller 116 skims the ink that has been coated on the developer roller 114, so that the ink is more solid than liquid. For instance, after skimming by the squeegee roller 116, the ink coated on the developer roller 114 may be 80% solid and 20% liquid.

After skimming, the ink remaining on the developer roller 114 is selectively transferred to the photoconductive drum 102, which is rotating in the opposite direction in relation to the developer roller 114 as indicated in FIG. 1. The photoconductive drum 102 has previously been selectively charged in correspondence with the image desired to be formed on the media sheet 118. The ink on the developer roller 114 is transferred to the photoconductive drum 102 just where the drum 102 has been selectively charged. Thereafter, the photoconductive drum 102 makes contact with a blanket drum 101, which makes contact with the media sheet 118 to transfer the ink onto the media sheet 118. In this way, a desired image is formed on the media sheet 118. The drums 101 and 102 rotate as indicated in FIG. 1.

The ink that is not transferred from the developer roller 114 to the photoconductive drum 102 is referred to as unused ink. The BID 104 includes a cleaner roller 120, which is rotating as indicated in FIG. 1 and is at an electrical potential that is less negative than the developer roller 114, such as −250 volts. The cleaner roller 120 cleans the unused ink from the developer roller 114.

The BID 104 includes a sponge roller 122, which rotates in the same direction as the cleaner roller 120. The sponge roller 122 is a sponge in that it has a number of open cells, or pores. For instance, the sponge roller 122 may be made from open-cell polyurethane foam. The sponge roller 122 can be compressed, and is compressed by its path being interfered with by the secondary electrode 112, the cleaner roller 120, and a squeezer roller 130 of the BID 104.

The sponge roller 122 absorbs the unused ink cleaned by the cleaner roller 120, and by a wiper blade 124, from the developer roller 114. That is, any unused ink remaining on the cleaner roller 120 that is not absorbed by the sponge roller 122 is scraped from the cleaner roller 120 into the sponge roller 122 by the wiper blade 124. The wiper blade 124 is part of a wiper mechanism 126 of the BID 104, and the wiper mechanism 126 also includes a wiper (back) wall 128, as is described in more detail later in the detailed description.

The squeezer roller 130 wrings out (i.e., releases) the unused ink that has been absorbed by the sponge roller 122 for reuse. Thus, the unused ink released from the sponge roller 122 by the squeezer roller 130 returns to the ink tray 108. The sponge roller 122 further serves to break up solid parts of the unused ink, which is more solid than liquid, so that the ink returns to being more liquid than solid. The squeezer roller 130 releases the unused ink from the sponge roller 122 by compressing the sponge roller 122. That is, the squeezer roller 130 squeezes the sponge roller 122 to release the unused ink from the sponge roller 122.

After the sponge roller 122 has been compressed, it subsequently expands, as can be appreciated by those of ordinary skill within the art. Compression of the sponge roller 122 results in at least air being released from the cells of the sponge roller 122. By comparison, expansion of the sponge roller 122 results in at least air being drawn into (i.e., suctioned into) the cells of the sponge roller 122. Thus, expansion of the sponge roller 122 creates a negative air pressure.

Compression of the sponge roller 122, particularly by the squeezer roller 130, has been found to result in undesired ink foam. The air that is released from the sponge roller 122 during compression of the roller 122 interacts with the ink to result in this ink foam. How ink foam is generated within the BID 104, and how embodiments of the present disclosure ensure that such ink foam does not escape the BID 104, is now described.

Figure 2:
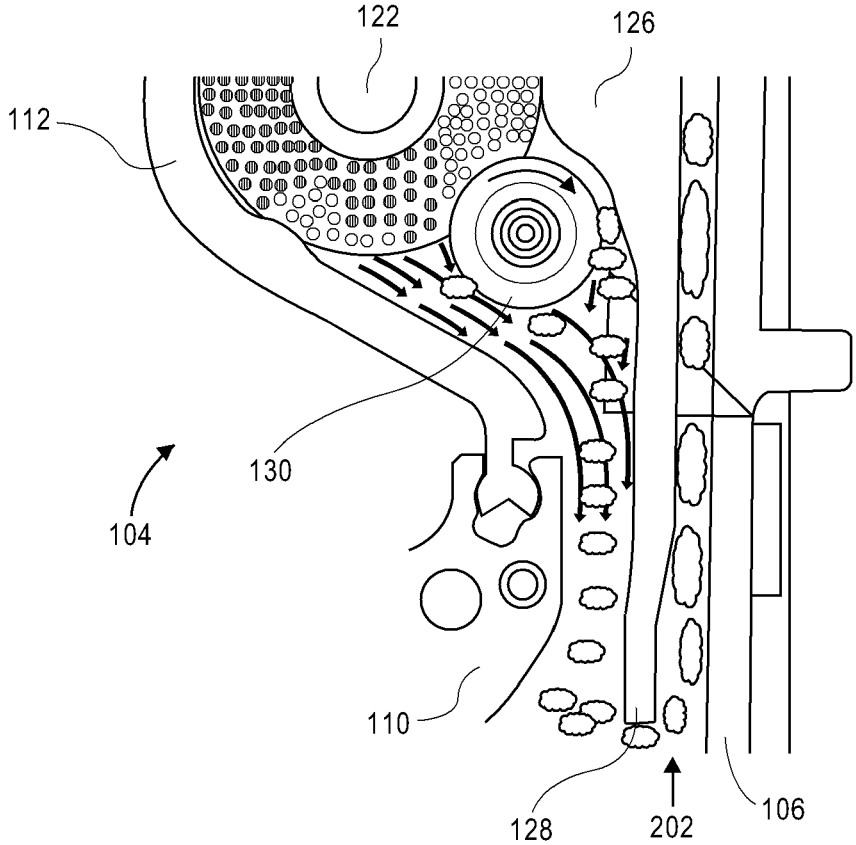
FIG. 2 is a diagram depicting how ink foam may be generated within a BID for an LEP printing device, according to an embodiment of the present disclosure.

FIG. 2 shows how ink foam is generated within the BID 104, according to an embodiment of the present disclosure. A portion of the BID 104 is depicted in FIG. 2, specifically depicting compression of the sponge roller 122 against the secondary electrode 112 and the squeezer roller 130. The back wall 128 of the wiper mechanism 126, the housing 106, and the primary electrode 110 are also depicted in FIG. 2.

The sponge roller 122 is shown as having a number of cells, which are represented by circles in FIG. 2. The shaded circles denote cells of the sponge roller 122 that have absorbed unused ink, whereas the unshaded circles denote cells of the roller 122 that have had their absorbed unused ink released. Thus, compression of the sponge roller 122 by the squeezer roller 130, and also by the secondary electrode 112, causes the unused ink absorbed by the cells of the sponge roller 122 to be released therefrom.

However, as has been indicated above, compression of the sponge roller 122 also results in air being released from the cells of the sponge roller 122. This air interacts with the ink to form undesired ink foam, which is represented in FIG. 2 as clouds. The ink foam gravitates downwards to the left of the back wall 128 of the wiper mechanism 126.

Figure 3:
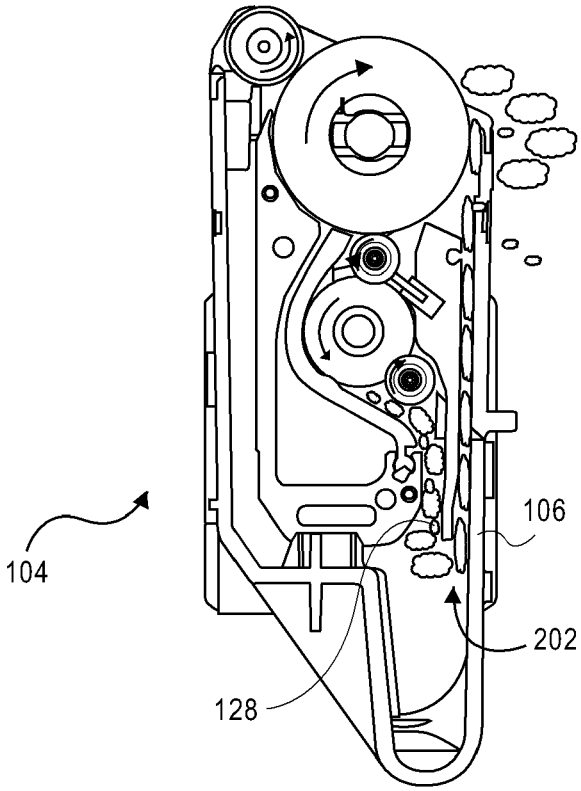
FIG. 3 is a diagram depicting how ink foam may undesirably emanate from a BID for an LEP printing device, according to an embodiment of the present disclosure.

The housing 106 together with the back wall 128 define a passageway 202. This passageway 202 is ultimately externally exposed to the BID 104, as can be seen in FIG. 1, for instance. The ink foam is drawn into the passageway 202 by capillary action and/or buoyancy. As such, the ink foam can escape from the BID 104, which can result in image quality issues and other problems. FIG. 3 specifically shows how ink foam can undesirably escape from the BID 104 via the passageway 202 between the back wall 128 and the housing 106, according to an embodiment of the present disclosure.

Current approaches to dealing with the ink foam problem have concentrated on reducing the generation of ink foam. For instance, the BID 104 may be positioned within the LEP printing device 100 in such a way that less ink foam is generated. As another example, the chemical formulation of the ink itself may be varied so that the ink is less susceptible to generation of ink foam. Both of these approaches, however, place constraints on the development of LEP printing devices.

Figure 4A:
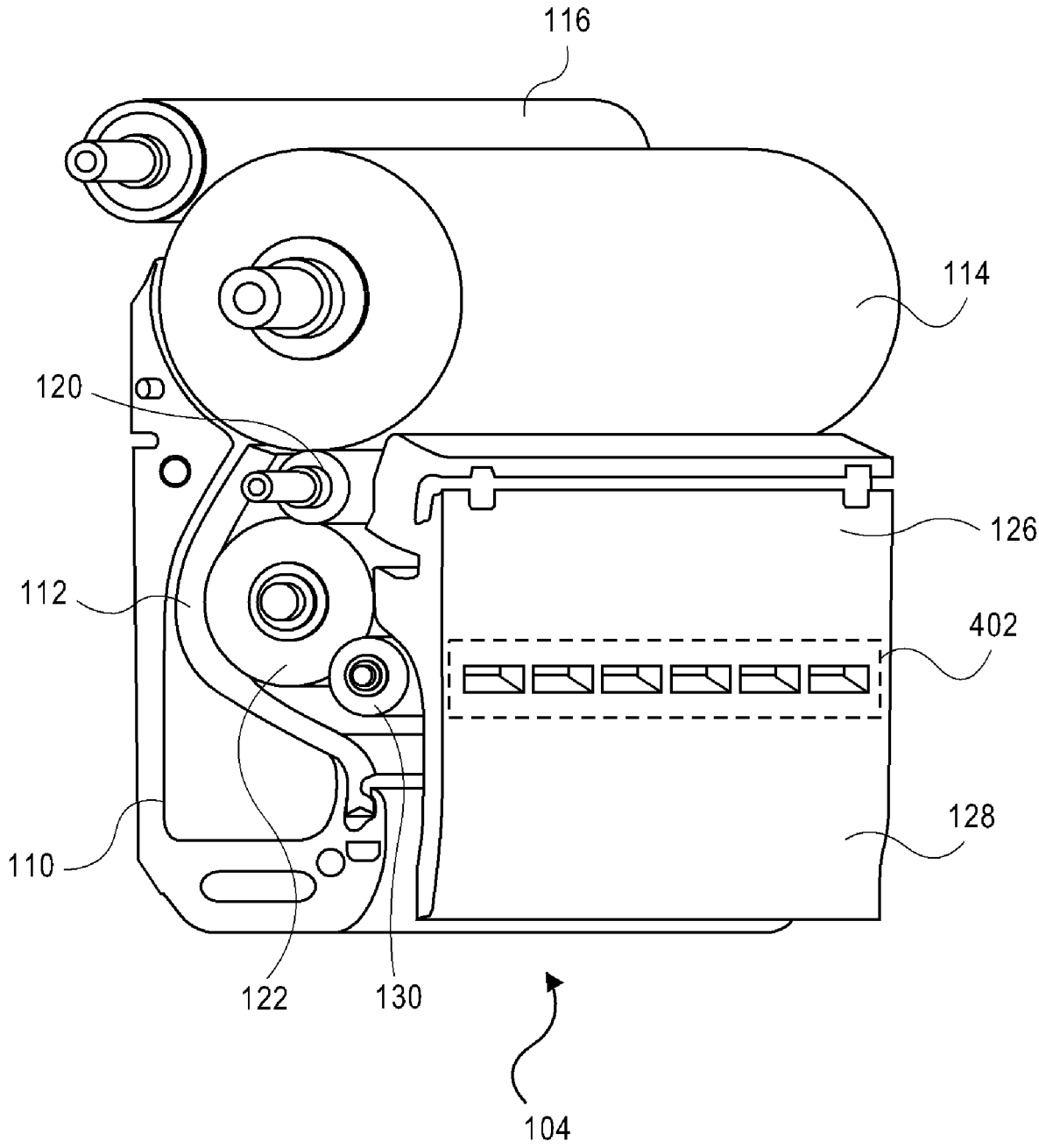
FIGS. 4A, 4B, and 4C are diagrams of a BID for an LEP printing device that includes a number of suction cavities to prevent ink foam from undesirably emanating from the BID, according to an embodiment of the present disclosure.
Figure 4B:
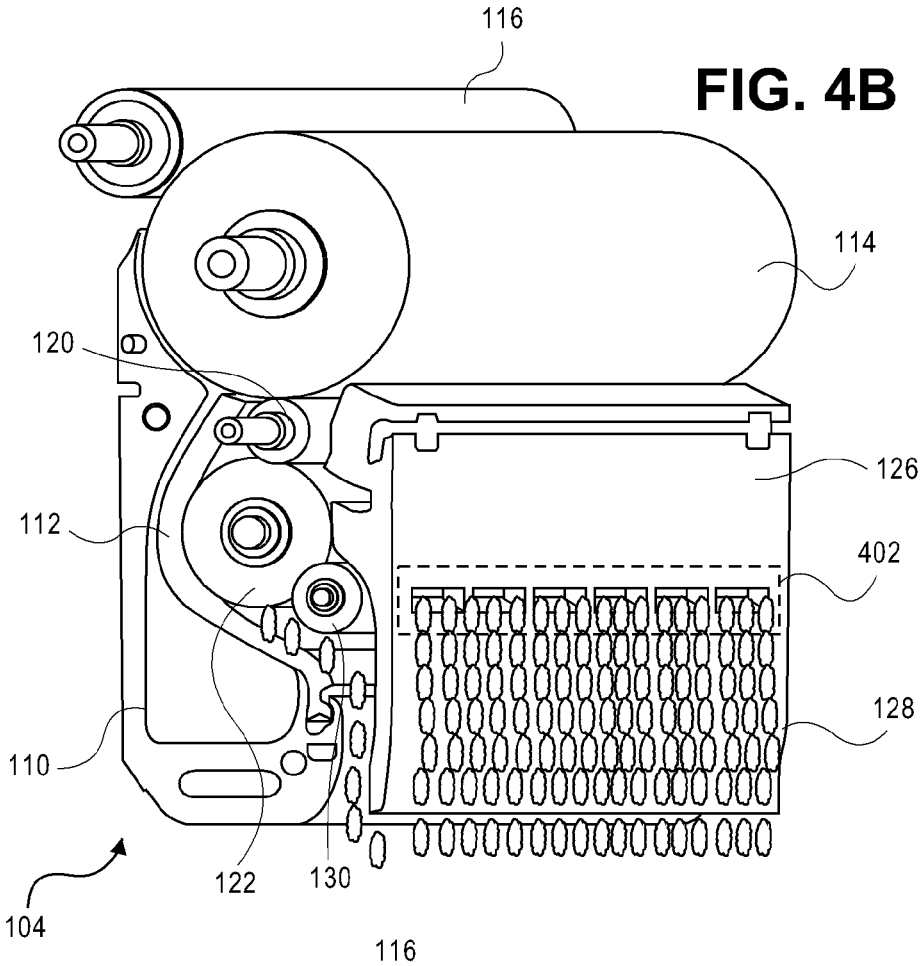
Figure 4C:
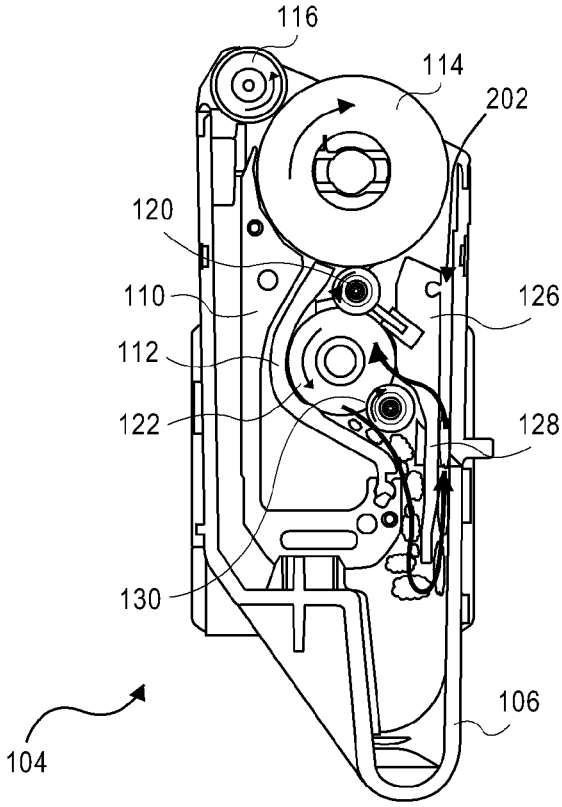

By comparison, FIGS. 4A, 4B, and 4C show how the BID 104 may include a number of suction cavities 402 within the back wall 128 of the wiper mechanism 126 to ensure that ink foam does not undesirably escape from the BID 104, according to an embodiment of the present disclosure. That is, the insight provided by this embodiment of the present disclosure is that ink foam in and of itself is not what is problematic, but rather that ink foam is problematic just when it escapes the BID 104. Therefore, this embodiment of the present disclosure solves the ink foam problem not by reducing the generation of ink foam, as has been the focus of the prior art, but rather by ensuring that the ink foam does not escape from the BID 104.

In FIG. 4A, a portion of the BID 104 is depicted in which the housing 106 is not shown for illustrative clarity. The back wall 128 of the wiper mechanism 126 includes a number of suction cavities 402. The suction cavities 402 provide a path for the ink foam back from the passageway 202 (not depicted in FIG. 4A) to the other side, such as to the sponge roller 122 and/or to the squeezer roller 130.

FIG. 4B shows how the ink foam is generated where the sponge roller 122 is interfered with by the secondary electrode 112 and the squeezer roller 130, gravitates downward, and then migrates upwards against the back wall 128. But for the suction cavities 402, the ink foam would continue migrating upwards until it escaped the BID 104. However, the presence of the suction cavities 402 ensures that the ink foam instead moves back to the other side of the back wall 128 of the wiper mechanism 126. As such, the ink foam does not emanate externally from the BID 104, and thus cannot cause image quality issues and other problems.

FIG. 4C shows an arrowed path of the ink foam from the point where it is generated, to the point where it is suctioned through the suction cavities 402 back from the passageway 202 between the back wall 128 and the housing 106. The suction cavities 402 are not explicitly referenced in FIG. 4C. The ink foam is generated where the sponge roller 122 is interfered with by the secondary electrode 112 and the squeezer roller 130, gravitates downward, and then migrates upward within the passageway 202.

Rather than continuing to migrate upgrades through the passageway 202 and exiting the BID 104, the ink foam is instead suctioned through the internal suction cavities 402 back from the passageway 202 due to negative air pressure being created by the sponge roller 122 expanding after having been compressed by the squeezer roller 130. As has been noted above, expansion of the sponge roller 122 causes air to be suctioned into the sponge roller 122, which results in the creation of negative air pressure. As such, the suction cavities are located in one embodiment where they maximally leverage this negative air pressure.

Likewise, the number of the suction cavities 402 (i.e., one or more) and the geometry of the cavities 402 are specified so that they maximally leverage the negative air pressure. Empirical testing can be performed to determine the optimal number, geometry, and location of the suction cavities 402 to so maximally leverage the negative air pressure so that at least substantially all of the ink foam is suctioned through the cavities 402. The suction cavities 402 may be fabricated by laser cutting, wire cutting, and/or machining.

Figure 5:
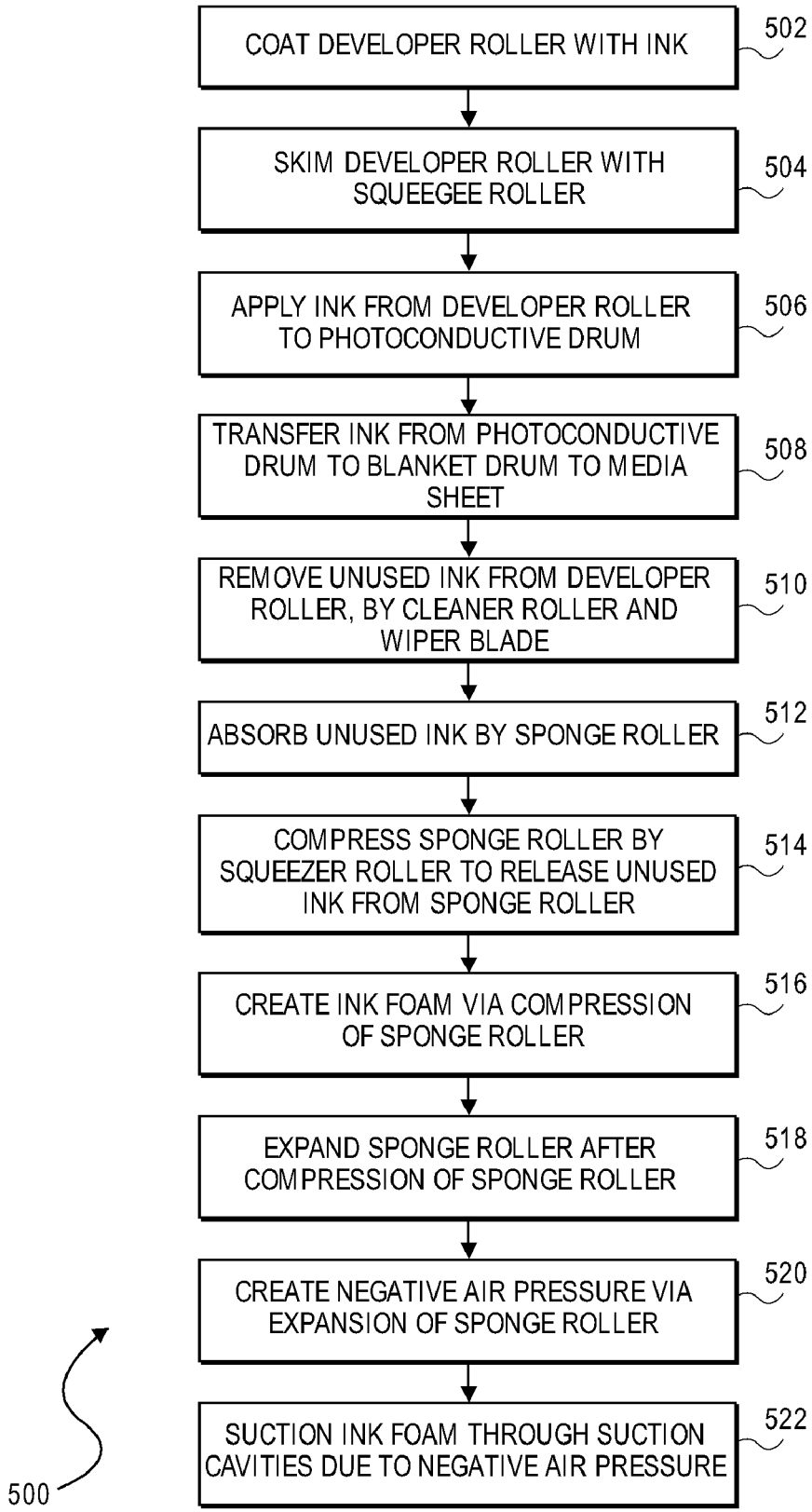
FIG. 5 is a flowchart of a method, according to an embodiment of the present disclosure.

In conclusion, FIG. 5 shows a method 500 that summarizes how ink foam is generated and subsequently captured using the suction cavities 402, according to an embodiment of the present disclosure. The developer roller 114 is coated with ink (502), and is skimmed by the squeegee roller 116 (504). Thereafter, the ink is applied to the photoconductive drum 102 from the developer roller 114 (506), and transferred from the photoconductive drum 102, and then from the photoconductive drum 102 to the blanket drum 101, and finally from the blanket drum 101 to the media sheet 118 (508). Any unused ink is removed by the cleaner roller 120 from the developer roller 114 (510) (and by the wiper blade 124 scraping the cleaner roller 120, as has been described), and is absorbed by the sponge roller 122 (512).

The squeezer roller 130 then compresses the sponge roller 122 to release the unused ink from the sponge roller 122 (514). This compression of the sponge roller 122 creates ink foam (516). After a portion of the sponge roller 122 is compressed, this portion expands when it is no longer interfered with by the squeezer roller 130 (518). Such expansion of the sponge roller 122 creates negative air pressure (520), due to the cells of the sponge roller 122 suctioning air. Ink foam that has gravitated downwards and then migrated upwards within the passageway 202 via buoyancy and/or capillary action is suctioned through the suction cavities 402 due to the negative air pressure that has been created (522).

We claim:

1. A binary ink developer (BID) for a liquid electro-photography (LEP) printing device, comprising:

a sponge roller to absorb unused ink;

a squeezer roller to release the unused ink absorbed by the sponge roller for reuse, the squeezer roller releasing the unused ink absorbed by the sponge roller by compressing the sponge roller, compression of the sponge roller resulting in ink foam;

a mechanism having a wall;

a housing that together with the wall of the mechanism defines a passageway between the housing and the wall, the passageway exposed externally to the BID; and, one or more suction cavities defined within the wall of the mechanism through which the ink foam moves back from the passageway.

2. The BID of claim 1, further comprising:

a developer roller to apply ink to a photoconductive drum of the LEP printing device, any of the ink unapplied becoming the unused ink; and, a cleaner roller to remove the unused ink from the developer roller, the sponge roller absorbing the unused ink removed by the cleaner roller from the developer roller, wherein the mechanism is a wiper mechanism that also has a wiper blade attached to the wall to scrape the cleaner roller, and wherein the cleaner roller also compresses the sponge roller.

3. The BID of claim 2, further comprising:

a primary electrode at an electrical potential more negative than an electrical potential of the developer roller;

a secondary electrode also compressing the sponge roller;

an ink tray defined by the housing, the ink traveling from the ink tray and between the primary electrode and the secondary electrode to coat the developer roller; and, a squeegee roller to skim the ink coated on the developer roller prior to the ink being applied to the photoconductive drum wherein the squeegee roller is at an electrical potential less negative than the electrical potential of the primary electrode and more negative than the electrical potential of the developer roller, and wherein the cleaner roller is at an electrical potential less negative than the electrical potential of the developer roller.

4. The BID of claim 3, wherein the sponge roller, the squeezer roller, the wiper mechanism, the developer roller, the cleaner roller, the primary electrode, the secondary electrode, and the squeegee roller are each at least substantially disposed within the housing.

5. The BID of claim 3, wherein:

the ink is more liquid than solid upon traveling from the ink tray and between the primary electrode and the secondary electrode to coat the developer roller, and is more solid than liquid upon being skimmed by the squeegee roller, such that the unused ink is more solid than liquid, the sponge roller, by absorbing the unused ink, is to render the unused ink more liquid than solid by breaking up solid parts of the unused ink.

6. The BID of claim 1, wherein compression of the sponge roller results in the ink foam due to release of air upon the sponge roller being compressed, the air interacting with the unused ink to create the ink foam.

7. The BID of claim 1, wherein one or more of capillary action and buoyancy causes the ink foam to move upwards the passageway between the housing and the wall.

8. The BID of claim 1, wherein after the sponge roller is compressed by the squeezer roller the sponge roller expands, expansion of the sponge roller resulting in air being suctioned into the sponge roller such that a negative air pressure is created.

9. The BID of claim 8, wherein the negative air pressure created by expansion of the sponge roller suctions the ink foam back from the passageway through the suction cavities.

10. The BID of claim 9, wherein locations of the suction cavities along the wall of the mechanism are specified so that the negative air pressure created by expansion of the sponger roller is maximally leveraged to suction the ink foam back from the passageway through the suction cavities.

11. The BID of claim 9, wherein a number of the suction cavities is specified so that the negative air pressure created by expansion of the sponge roller is maximally leveraged to suction the ink foam back from the passageway through the suction cavities.

12. The BID of claim 9, wherein geometries of the suction cavities are specified so that the negative air pressure created by expansion of the sponge roller is maximally leveraged to suction the ink foam back from the passageway through the suction cavities.

13. A liquid electro-photography (LEP) printing device comprising:

a photoconductive drum that is selectively charged in correspondence with an image to be formed on media, the photoconductive drum having ink applied thereto where the photoconductive drum has been charged;

a blanket drum, the ink transferred from the photoconductive drum to the blanket drum, and from the blanket drum to the media; and, a binary ink developer (BID) to apply the ink to the photoconductive drum, the BID having one or more internal suction cavities to prevent ink foam generated within the BID from emanating outwards of the BID.

14. The LEP printing device of claim 13, wherein the BID comprises:

a developer roller to apply the ink to the photoconductive drum, any of the ink unapplied becoming unused ink;

a cleaner roller to remove the unused ink from the developer roller;

a sponge roller to absorb the unused ink removed by the cleaner roller from the developer roller;

a wiper mechanism having a wiper blade to scrape the cleaner roller, and a wall;

a squeezer roller to release the unused ink absorbed by the sponge roller for reuse, the squeezer roller releasing the unused ink absorbed by the sponge roller by compressing the sponge roller, compression of the sponge roller resulting in the ink foam; and, a housing that together with the wall of the wiper mechanism defines a passageway between the housing and the wall, the passageway exposed externally to the BID, wherein the internal suction cavities are defined within the wall of the wiper mechanism through which the ink foam moves back from the passageway.

15. The LEP printing device of claim 14, wherein compression of the sponge roller results in the ink foam due to release of air upon the sponge roller being compressed, the air interacting with the unused ink to create the ink foam.

16. The LEP printing device of claim 14, wherein after the sponge roller is compressed by the squeezer roller the sponge roller expands, expansion of the sponge roller resulting in air being suctioned into the sponge roller such that a negative air pressure is created.

17. The LEP printing device of claim 16, wherein the negative air pressure created by expansion of the sponge roller suctions the ink foam back from the passageway back into through the internal suction cavities.

18. The LEP printing device of claim 17, wherein geometries, locations, and/or a number of the internal suction cavities along the wall of the mechanism are specified so that the negative air pressure created by expansion of the sponger roller is maximally leveraged to suction the ink foam back from the passageway back through the internal suction cavities.

19. A method comprising:

absorbing unused ink by a sponge roller of a binary ink developer (BID) for a liquid electro-photography (LEP) printing device;

compressing the sponge roller by a squeezer roller of the BID to release the unused ink absorbed by the sponge roller for reuse;

creating ink foam via compression of the sponge roller by the squeezer roller;

expanding the sponge roller after compression of the sponge roller by the squeezer roller;

creating negative air pressure via expansion of the sponge roller; and, suctioning the ink foam through one or more suction cavities of the BID due to the negative air pressure created.

20. The method of claim 19, further comprising:

coating a developer roller of the BID with ink;

skimming the developer roller of the BID with a squeegee roller of the BID;

applying the ink from the developer roller to a photoconductive drum of the LEP printing device where the photoconductive drum has been selectively charged, any of the ink unapplied becoming the unused ink; and, removing the unused ink from the developer roller by a cleaner roller of the BID, such that the sponge roller absorbs the unused ink removed by the cleaner roller from the developer roller.

* * * * *

UNITED STATES PATENT AND TRADEMARK OFFICE

CERTIFICATE OF CORRECTION

PATENT NO. : 7,668,488 B2
APPLICATION NO. : 11/872663
DATED : February 23, 2010
INVENTOR(S) : Marco A. Guzman et al.

It is certified that error appears in the above-identified patent and that said Letters Patent is hereby corrected as shown below:

In column 5, line 42, in Claim 3, delete "drum" and insert -- drum, --, therefor.

In column 6, line 14, in Claim 10, delete "sponger" and insert -- sponge --, therefor.

In column 7, line 11, in Claim 18, delete "sponger" and insert -- sponge --, therefor.

Signed and Sealed this

Fourth Day of May, 2010

David J. Kappos

David J. Kappos
*Director of the United States Patent and Trademark Office*